US005966857A

United States Patent [19]

Pettersson et al.

[11] Patent Number: 5,966,857

[45] Date of Patent: Oct. 19, 1999

[54] ADVERTISING DISPLAY

[75] Inventors: Joakim Pettersson, Nybro, Sweden; Christer Wernerdal, Hermosa Beach, Calif.

[73] Assignee: ADBOX, Inc., Hermosa Beach, Calif.

[21] Appl. No.: 08/951,594

[22] Filed: Oct. 16, 1997

[51] Int. Cl.[6] ..... G09F 15/00

[52] U.S. Cl. ..... 40/606; 40/610

[58] Field of Search ..... 40/606, 124.19, 40/539, 605; 248/174, 688

[56] References Cited

U.S. PATENT DOCUMENTS

| | | | |
|---|---|---|---|
| D. 378,301 | 3/1997 | Leksell . | |
| 1,548,237 | 8/1925 | Ackermann | 40/539 |
| 1,576,672 | 3/1926 | Miller | 40/539 |
| 1,987,418 | 1/1935 | Plishker et al. | 40/539 |
| 2,080,105 | 5/1937 | Bacon | 248/174 |
| 2,880,534 | 4/1959 | Lund | 40/124.19 |
| 4,991,335 | 2/1991 | Krautsack | 40/539 |
| 5,249,771 | 10/1993 | Wear | 40/539 |
| 5,416,997 | 5/1995 | Dyment et al. | 40/610 |
| 5,787,621 | 8/1998 | Leksell | 40/606 |
| 5,826,732 | 10/1998 | Ragsdale | 248/174 |

FOREIGN PATENT DOCUMENTS

| | | | |
|---|---|---|---|
| 1817961 | 12/1968 | Germany | 40/610 |
| 2802557 | 7/1979 | Germany | 248/174 |
| 696391 | 8/1953 | United Kingdom | 40/539 |

*Primary Examiner*—Terry Lee Melius
*Assistant Examiner*—Marcos Dolce
*Attorney, Agent, or Firm*—Blakely, Sokoloff, Taylor & Zafman LLP

[57] ABSTRACT

An advertising display which is easily erected and may be used as a free-standing display or as a hanging display. The display is comprised of two sub-assemblies which are folded flat for shipment and which may be popped open and slipped together to form a commanding display. Provision is made for allowing the display to be hung from above, or alternatively, a pair of feet assemblies are provided which may be attached adjacent the base of the display to provide a stable free-standing display. The feet, if used, engage the rest of the display in a positive manner so as to remain attached to the display if the display is lifted for movement, etc. Exemplary embodiments are disclosed.

16 Claims, 5 Drawing Sheets

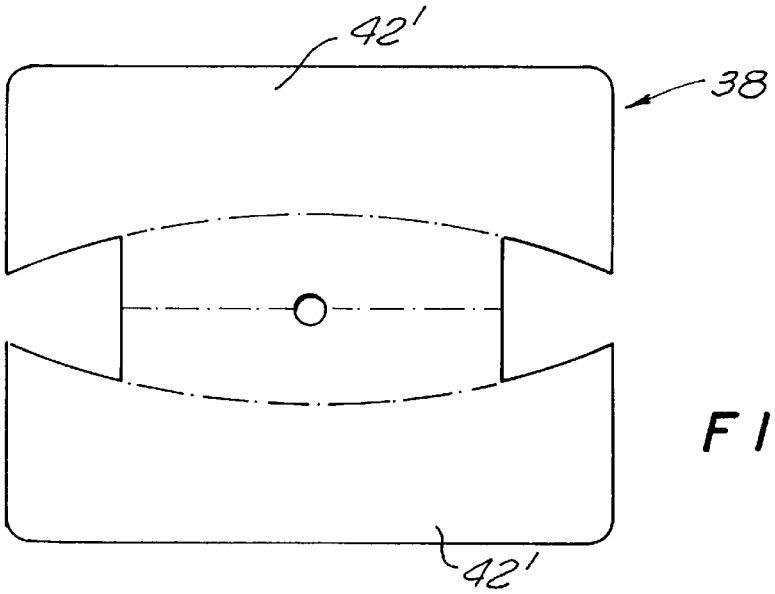
FIG. 10
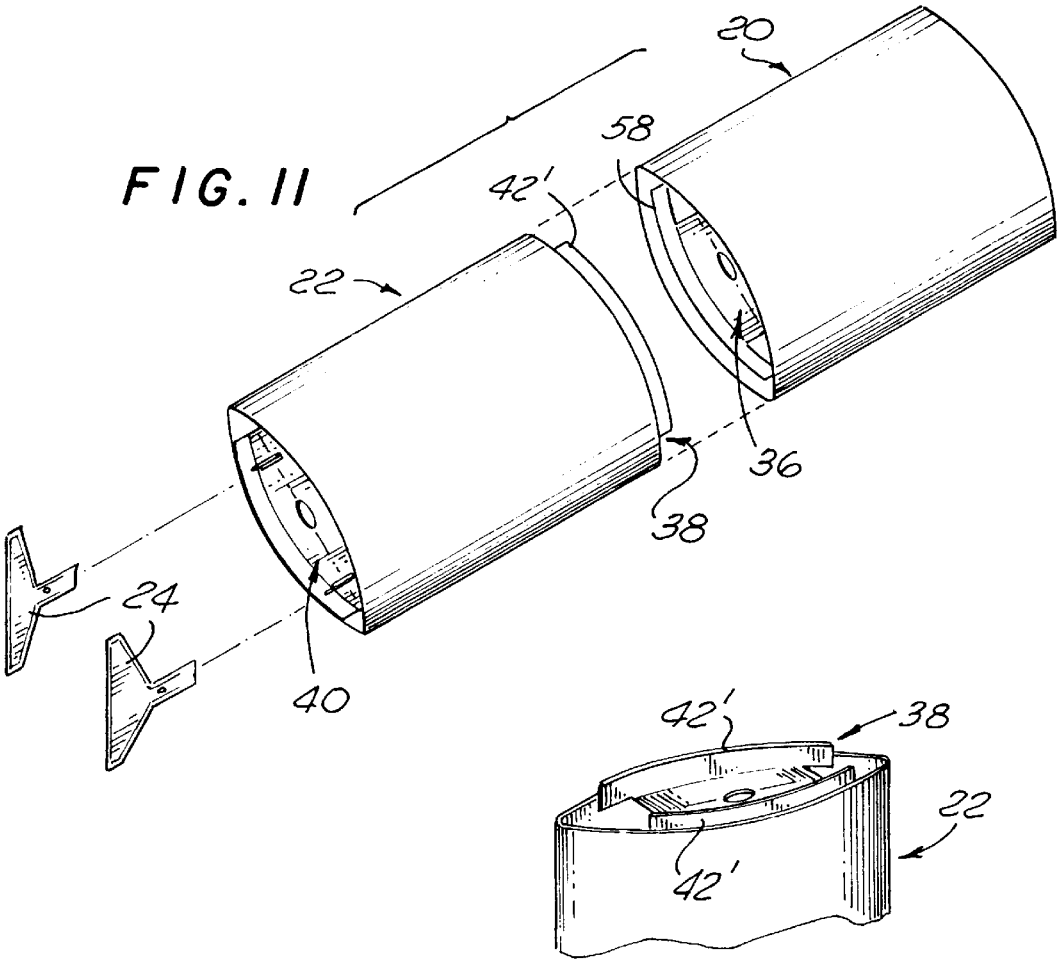
FIG. 11
FIG. 12

ADVERTISING DISPLAY

BACKGROUND OF THE INVENTION

1. Field of the Invention

The present invention relates to the field of displays for advertising purposes and the like.

2. Prior Art

The prior art believed to be closest to the present invention is a product generally in accordance with U.S. Design Pat. No. 378,301. Since the present invention represents a substantial improvement over the structure of that display, the structure of that display will be described in some detail herein.

The prior art display, like the present invention display, uses upper and lower display panel sub-assemblies which fold flat and which, when held open and stacked one to another, provide the finished display. To hold the sub-assemblies open, separate center sub-assemblies are provided which also fold flat and which must be opened and locked into an open position and assembled, one to another, prior to opening the upper and lower panel sub-assemblies and sliding the latter assembly thereinto. Thus, the actual sub-assemblies having the surfaces of the display on which the advertising or other material is printed is separate from the structural assembly used to hold the display in an open condition.

The foregoing structure has a number of disadvantages over the present invention. The two sub-assemblies which form the actual display surfaces are initially physically independent of the additional two sub-assemblies which must be assembled and placed therein to hold the display in the open condition. Consequently, the overall assembly procedure is substantially more complicated and time consuming than in the present invention. Also, the assemblies forming the internal structure of the display are not positively located with respect to sub-assemblies which form the display panels of the display itself, thereby requiring adjustment of position of that internal structure with respect to the sub-assemblies forming the display panels to center the same therein. Further, because the sub-assemblies forming the display panels must be manually opened for insertion of the assembly forming the center structure of the display, the opportunity exists to excessively open those sub-assemblies so as to form an unsightly permanent crease therein, probably preventing those sub-assemblies from elastically closing around the center structure to frictionally retain the parts relative to each other.

Thus, while the prior art display can provide a commanding appearance, as in the present invention, the structure thereof, and thus the assembly required, is much more complicated than that of the present invention.

BRIEF SUMMARY OF THE INVENTION

An advertising display which is easily erected and may be used as a free-standing display or as a hanging display is disclosed. The display is comprised of two sub-assemblies which are folded flat for shipment and which may be popped open and slipped together to form a commanding display. Provision is made for allowing the display to be hung from above, or alternatively, a pair of feet assemblies are provided which may be attached adjacent the base of the display to provide a stable free-standing display. The feet, if used, engage the rest of the display in a positive manner so as to remain attached to the display if the display is lifted for movement, etc. Exemplary embodiments are disclosed.

BRIEF DESCRIPTION OF THE DRAWINGS

FIG. 10 is a face view of member 38.

FIG. 11 is an exploded perspective view of the erected display of the present invention.

FIG. 12 is a view of regions 42' as visible in FIG. 11, but taken on a different perspective.

DETAILED DESCRIPTION OF THE INVENTION

Figure 1:
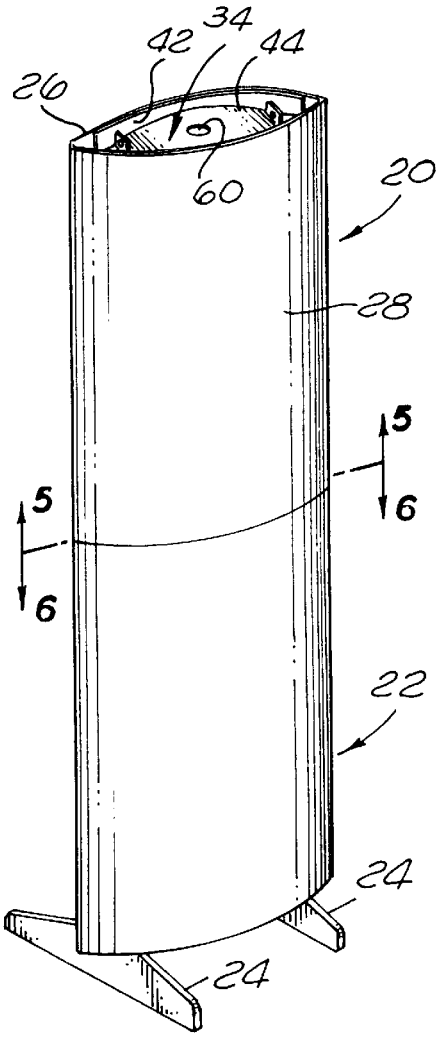
FIGS. 1, 2 and 3 are a perspective view, a front view and a side view of the preferred embodiment of the present invention as used as a free-standing advertising display.
Figure 2:
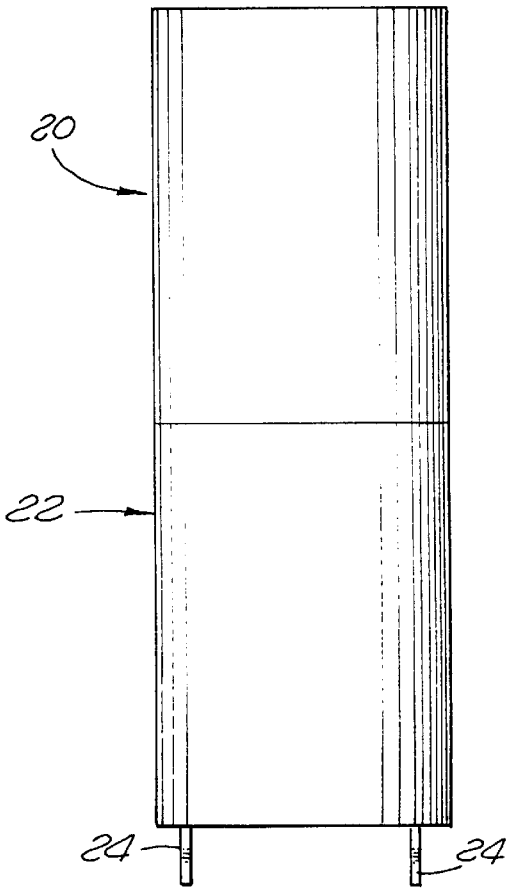
Figure 3:
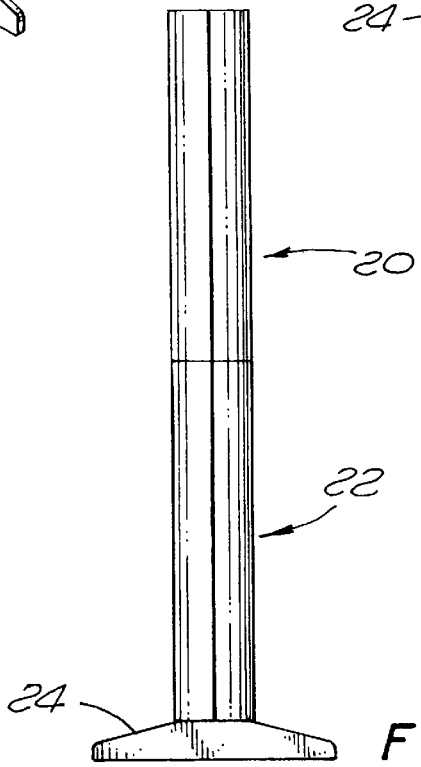

First referring to FIGS. 1, 2 and 3, a perspective view, a front view and a side view of the preferred embodiment of the present invention as used as a free-standing advertising display may be seen. The display comprises an upper sub-assembly 20, a lower sub-assembly 22, and when used as a free-standing display, a pair of feet assemblies 24.

Figure 4:
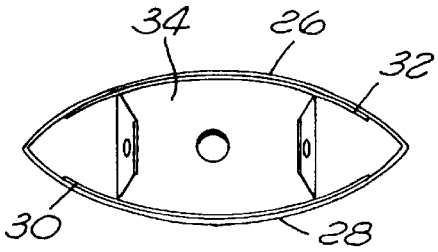
FIG. 4 is a top view of the assembly of FIGS. 1 through 3.

FIG. 4 is a top view of the assembly of FIGS. 1–3, illustrating among other things, the general cross-section of the exterior surfaces of the display. In particular, each of the sub-assemblies 20 and 22 in the preferred embodiment is formed by a pair of sheet members 26 and 28, each folded adjacent one edge thereof and bonded to the inside surface of the other edge of the other sheet member. This forms complimentary overlapping joints 30 and 32 at opposite sides of opposite edges of the corresponding sub-assembly of the display.

Figure 5:
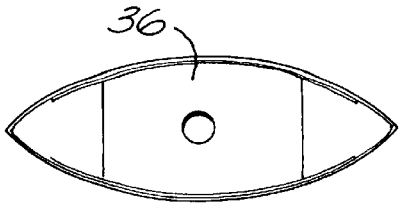
FIG. 5 is a cross-sectional view taken along line 5—5 of FIG. 1.
Figure 6:
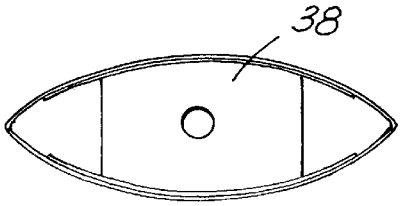
FIG. 6 is a cross-sectional view taken along line 6—6 of FIG. 1.
Figure 7:
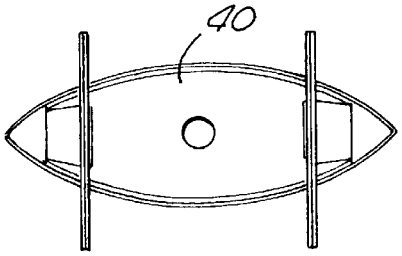
FIG. 7 is a bottom view of the assembly of FIGS. 1, 2 and 3.

The top of sub-assembly 20 is held in the approximately elliptical open shape shown by member 34. The lower portion of sub-assembly 20 is similarly held open by member 36 as shown in FIG. 5, a cross-sectional view taken along line 5—5 of FIG. 1. The lower sub-assembly 22 is held open adjacent the top thereof by a member 38 as shown in FIG. 6, a cross-sectional view taken along line 6—6 of FIG. 1, and adjacent the bottom thereof by a member 40 shown in FIG. 7. As shall be seen, members 34, 36, 38 and 40 are of a special design, and assembled at the time of manufacture by cementing or bonding the same in position on sheet members 26 and 28.

Figure 8:
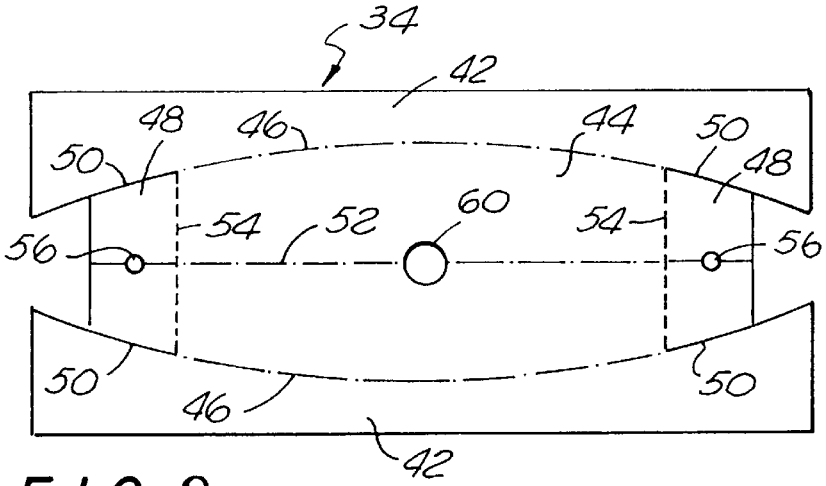
FIG. 8 is a face view of member 34 as laid flat, or as cut from sheet material.

Now referring to FIG. 8, a face view of member 34 (FIG. 4) as laid flat, or as cut from sheet material, may be seen. The top member is comprised of first and second side regions 42 integrally joined with a central region 44 along curved lines 46. The sheet member is slit, however, along lines 50 so that ends 48 are not directly joined to the side regions 42, but rather are only joined thereto through the central section 44.

The center line 52, as well as the lines 54 joining the end regions 48 with the center region 44, and lines 46, are shown as dashed lines, as these lines represent lines of reduced bending resistance of the sheet-like material. In particular, in the preferred embodiment, a thin corrugated cardboard is used for all the parts except the feet, with the lines of reduced resistance to bending (e.g. the fold lines) being defined either by pre collapsing the corrugation along those lines, by small spaced apart slits part way or entirely through the material to define the lines, or alternatively by both methods. As so defined, these lines define preferential fold lines, which in the final assembly will automatically hold the sheet members 26 and 28 apart as shown in FIGS. 1–7 by merely initially pulling the sheet members 26 and 28 apart upon erection of the display. In particular, when manufacturing the display, member 34 (FIG. 8) is folded over on itself along line 52, and the side regions 42 thereof will each be cemented to a respective one of sheet members 26 and 28 (see FIG. 1). Once folded flat on itself like this, member 34 will tend to remain flat, as will the other corresponding members, so that the upper and lower sub-assemblies 20 and 22 will remain flat for storage, shipping, etc. However, when the sheet members 26 and 28 are pulled apart adjacent the top of sub-assembly 20, member 34 will tend to unfold along line 52 and simultaneously fold along curved lines 46. Because lines 46 are curved, the central region 44 of member 34 will snap to a corresponding curvature as the central region 44 approaches a fully unfolded condition. Thus, the central region 44 (see FIG. 1) of member 34 will be curved, following the curvature of lines 46, stabley remaining in that position unless or until forcibly folded to the initial folded position by pushing down on member 34 along or adjacent the center fold line 52. In that regard, a center finger hole 60 is provided to assist in the opening of the display if necessary, though by proper selection of the curvature for lines 46, the display will snap into the open position by merely adequately separating sheet members 26 and 28. End members 48, which are provided with holes 56 therethrough, may be folded upward as shown in FIG. 1 for the hanging of the display from above if desired. For this purpose, the display may be hung by the holes 56, or a line may be passed through the holes and under member 38 or member 40, to be described, to positively secure the lower sub-assembly also.

Members 36, 38 and 40 (FIGS. 5, 6 and 7) are similar in function to member 34, each being folded flat along its center line in the respective sub-assembly 20 or 22, and snapping into the curved position described upon forcibly separating members 26 and 28 adjacent to the respective one of members 36, 38 or 40. For instance, as may be seen in FIG. 9, member 36 may be identical to member 34 (FIG. 8) in most respects, though of course regions 48 coupled to central region 44 of member 34 for hanging the display are not needed and thus do not appear in FIG. 9.

Figure 9:
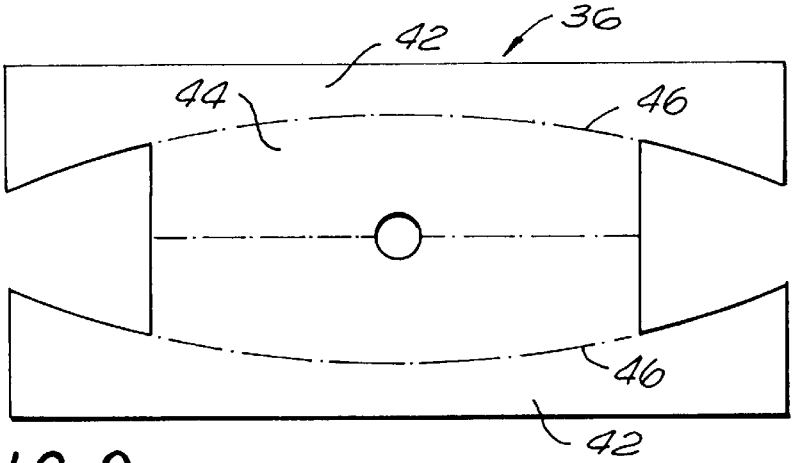
FIG. 9 is a face view of member 36.

Member 38 shown in FIG. 10 may be similar to member 36 shown in FIG. 9, though in the preferred embodiment the side regions 42' of member 38 are wider. Now, when member 38 is folded and cemented in position adjacent the top of the lower sub-assembly 22, part of regions 42' will extend beyond the top of the lower sub-assembly 22, as shown in FIGS. 11 and 12, so as to slip fit into the upper sub-assembly 20 upon erection of the display. In that regard, in the preferred embodiment, the top edge of region 42' projects above the top of lower sub-assembly 22 by a distance equal to the distance from the bottom of sub-assembly 20 to the bottom 58 (FIG. 11) of member 34 in the lower region of sub-assembly 20. This is not required, however, as the lower edge of the upper sub-assembly 20 will accurately rest on the upper edge of lower sub-assembly 22 if the parts are accurately made and assembled at the time of manufacture. Alternatively, of course, member 34 may be the member with the larger side regions so as to project downward into sub-assembly 22 on erection of the display. As an illustration of a still further alternate, but more complicated embodiment, entirely separate members may be pre-assembled on either (or both) sub-assemblies for this purpose.

Figure 13:
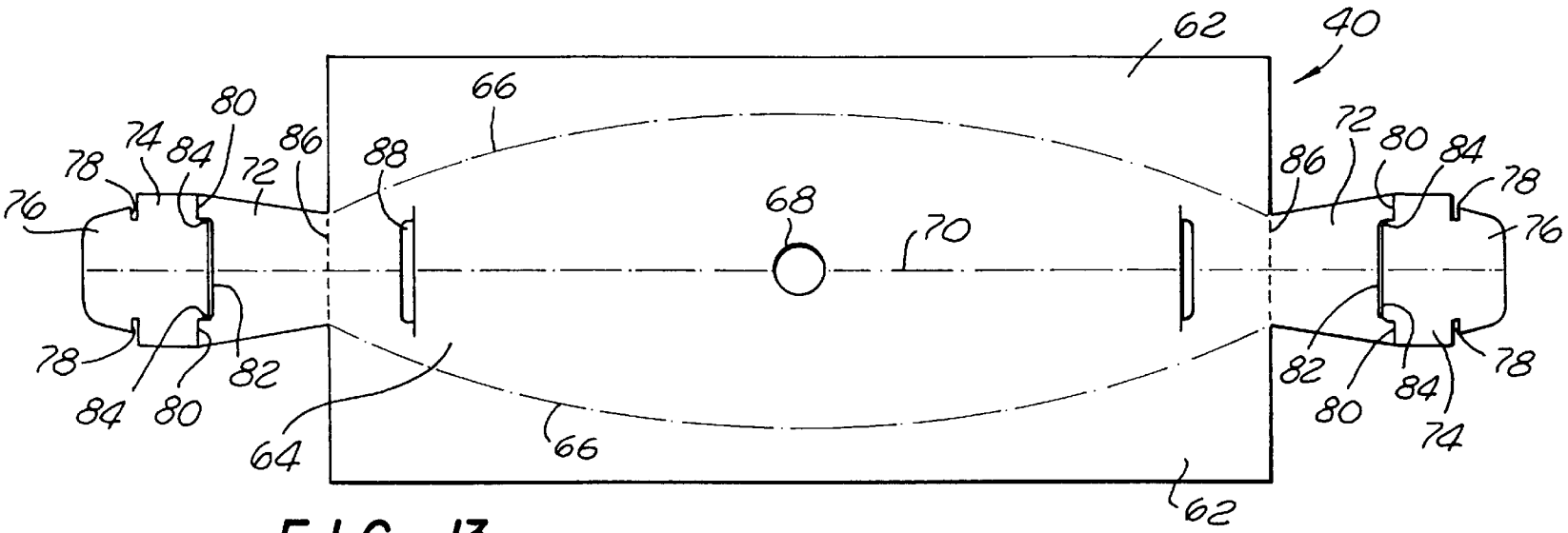
FIGS. 13 through 17 show details of member 40 and its folding to retain the feet assemblies.

Now referring to FIG. 13, details of member 40 (FIG. 7) may be seen. Like the other members 34, 36 and 38, member 40 has side regions 62 integral with central region 64, with curved lines of reduced resistance to bending 66 connecting regions 62 and 64. Also, like the other members mentioned, member 40 has a center fold line 70, also of reduced resistance to bending, and a finger hole 68.

In addition, member 40 includes side projections, each comprising a first region 72, a second region 74 and an end tab 76, the end tab 76 being separated from the adjacent region 74 by small slots or indentations 78. Regions 72 and 74 are joined or integral with each other along lines 80, though lines 82 and 84 represent slits wherein the material is cut all the way through. Further, for reasons which shall subsequently be seen, lines 80 represent lines of reduced resistance to bending, preferably in this instance defined by crushing of the corrugated material of the preferred embodiment to maintain strength while reducing the resistance to bending.

Figure 14:
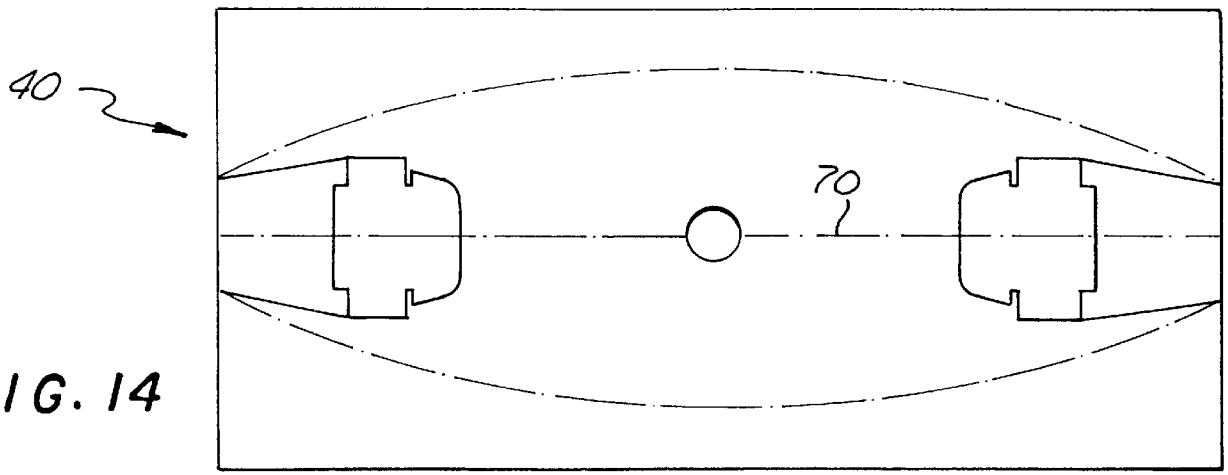

For the assembly of the sub-assemblies during manufacture, the projections at each end of member 40 are folded along lines 86, as shown in FIG. 14, so as to lie flat against the face of region 64, and then member 40 is folded along line 70 in a direction so that the projections are within the fold. To facilitate this bending and folding, lines 86 (FIG. 13) are preferably defined as lines of reduced resistance to bending, again preferably by crushing the material along those lines, rather than slitting the same, so as to preserve strength. Further, to facilitate the build-up in the thickness of the material when folding member 40 along line 70 (FIG. 14), it is preferable to initially slit the material along line 70 (FIG. 13) for at least a short distance at each side of fold lines 86 to allow some movement of the multiple layers resulting from the folds along lines 86 when the subsequent fold along line 70 is made.

Figure 15:
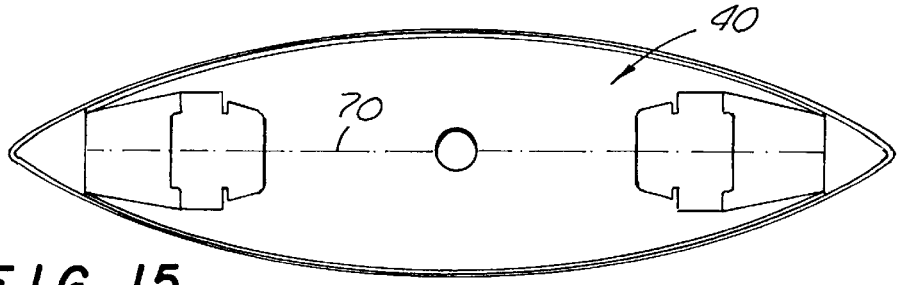
Figure 16:
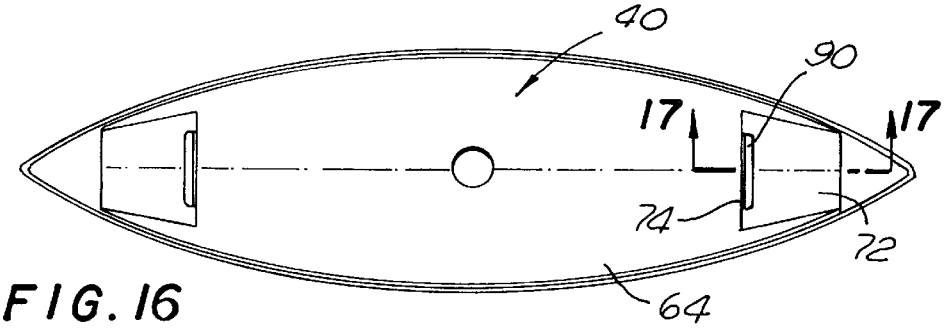

During erection of the display, the panels 26 and 28 adjacent member 40 in the folded sub-assembly are separated in the normal manner to have member 40 pop into the open position to retain the panels in separation. This is illustrated in FIG. 15, which is a bottom view of sub-assembly 22 just after member 40 has been popped into the stable open position shown. Thereafter, regions 72 and 74 at each side of member 40 are unfolded and folded respectively, with tab 76 being inserted into the respective slot 88 (see FIG. 13) to be retained therein by the slots or depressions 78 engaging the ends of each of slots 88. This may be seen in FIGS. 16, and FIG. 17 which is a view taken along line 17—17 of FIG. 16. As may be seen in one or both of FIGS. 16 and 17, slot 88 is somewhat wider than the thickness of region 74 and tab 76. Also, the folding of region 74 with respect to region 72 along fold lines 80 (FIG. 13) results in an opening or gap 90 between regions 72 and 74 (see both FIG. 16 and FIG. 17).

Figure 18:
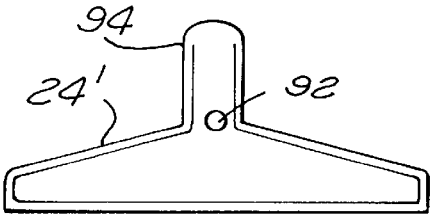
FIGS. 18 and 19 show details of the feet assemblies.
Figure 19:
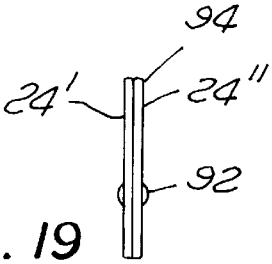

Now referring to FIGS. 18 and 19, general details of the feet assemblies 24 of FIG. 1 may be seen. FIG. 18 is a face view of one of the feet assemblies, with FIG. 19 being a side view of the assembly of FIG. 18. As may be seen in the figures, each of the feet assemblies 24 is comprised of a pair of identical members 24' and 24", held together with a small rivet-like member 92. In the preferred embodiment, members 24' and 24" are flat on their abutting sides, but have a ridge or thickening region around most of the periphery of the other side, providing increased strength and rigidity for the otherwise relatively thin members. These thickening regions are tapered adjacent the top 94 of each of members 24' and 24" so that the top of each of the feet assemblies forms a sort of a wedge to more easily facilitate assembly of the feet assemblies to the rest of the display.

Figure 17:
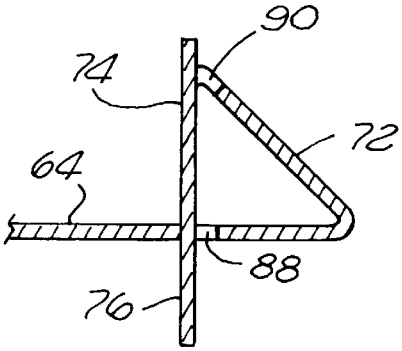
Figure 20:
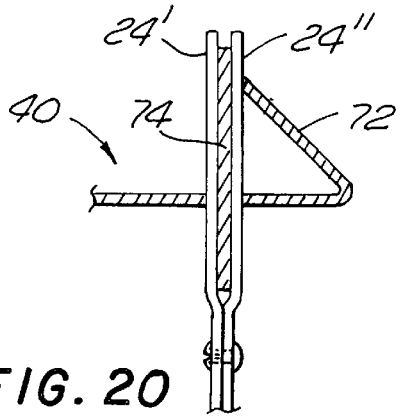
FIG. 20 illustrates the retention of the feet assemblies in the display assembly by member 40.

Now referring to FIG. 20, a view similar to that of FIG. 17 after the assembly of the feet assemblies to the lower sub-assembly 22 may be seen. As shown therein, the upper regions 94 (FIG. 18) of members 24' and 24" have been spread and pushed over region 74 so as to entrap region 74 there between. Further, the combination of thicknesses of members 74 and feet assembly members 24' and 24" now fills, or slightly more than fills, the respective slot 88 (FIG. 13) in member 40 to provide rather positive frictional retention of the feet assemblies. The relative dimensional proportions of regions 72 and 74 assure that region 74 will hold each of the feet assemblies in the desired erect position shown in FIGS. 1–3.

The display just described has important advantages over the prior art. In particular, each display, if used as a self-standing display, may be erected using only two sheet-like sub-assemblies and two feet assemblies, and if used as a hanging display, merely by erecting the display from two sheet-like sub-assemblies. This minimizes the number of parts required and the potential loss of parts, particularly if the displays are taken down for a subsequent later use. Also, since each of the sub-assemblies merely pops into the open position by separating the sheet-like members at each end, assembly directions and opportunity for error are minimal, so that the display may be erected without any special ability to read and follow instructions. Further, the parts themselves are relatively simple and may be easily die cut from sheet material and cemented (bonded) in place in the sub-assemblies as described. In that regard, while some additional parts are cemented to the sub-assemblies than were used in the prior art, cementing was still required in the prior art and accordingly, no major new operations are required for the manufacture of the display, yet major assembly operations at the time of display erection are eliminated.

As previously mentioned, in the preferred embodiment a relatively thin corrugated board is used for the sheet-like members. While in the preferred embodiment the two sides of the display are fabricated from two separate sheet members 26 and 28 (FIG. 4), obviously a single sheet-like member could be used if desired. Further, other materials could be used, such as by way of example, a non-corrugated board of some form, or even a rigid or semi-rigid plastic sheet, though for cost and convenience reasons, the thin corrugated board is preferred, as the plastic feet of a free standing display will hold the board off the floor to prevent deterioration from any water or other liquid that gets on the floor. In that regard, the finished display of the preferred embodiment, separate and apart from the feet assemblies, is approximately two meters tall, two thirds of a meter wide and twenty centimeters thick. Thus, the net result is a very simply erected, yet physically commanding advertising display which may be imprinted, typically pre-imprinted, with advertising or other material as desired, and which can be taken down and later re-erected with minimal risk of loss of parts because of the minimal number of parts required to form the finished display.

Thus, while preferred embodiments of the present invention have been disclosed, it will be obvious to those skilled in the art that various changes in form and detail may be made without departing from the spirit and scope of the invention.

What is claimed:

1. An advertising display comprising:

first and second advertising panels having top and bottom edges and first and second opposite side edges, the panels being joined along the first and second opposite side edges;

a pair of sheet-like spreader members between the first and second advertising panels adjacent the top and bottom edges, respectively, each spreader member having a central region and integral first and second side regions, each side region being coupled to the central region by curved lines of reduced resistance to bending, the central region having a fold line therethrough;

when the advertising display is in a folded state, each spreader member being folded through 180° along the fold line, with the first and second side regions being bonded to the first and second advertising panels, respectively, with the fold line of the central region approximately perpendicular to the first and second opposite side edges of the panels; and, when the panels are encouraged into separation adjacent each of the spreader members, the spreader members will unfold along the fold line through the central region and fold along the curved lines of reduced resistance to bending such that the central region is unfolded and curved following a curvature of the curved lines, thereby holding the central region in an unfolded position.

2. The advertising display of claim 1 wherein each spreader member has a hole in the central region thereof which may be used as a finger hole to unfold said spreader member.

3. The advertising display of claim 1 wherein the central region of one of the spreader members has an integral tab at each end thereof, each tab having a hole therein such that the tabs are bent upward for hanging the display from above through the holes in the tabs.

4. The advertising display of claim 1 wherein the central region of one of the spreader members includes a pair of means for engaging a foot for providing a free standing display.

5. The advertising display of claim 4 further comprising a pair of feet, each of the feet comprising an assembly of a pair of substantially identical plastic feet members for elastically engaging a respective one of the means for engaging a foot for providing a free standing display.

6. The advertising display of claim 1 wherein the first and second advertising panels are individual sheet-like members, each folded along on one of the side edges and bonded to an unfolded side edge of the other sheet-like member.

7. The advertising display of claim 1 wherein the first and second advertising panels and the spreader members are corrugated cardboard members.

8. An advertising display comprising:

a pair of subassemblies, each having:

first and second advertising panels having top and bottom edges and first and second opposite side edges, the panels being joined along the first and second opposite side edges;

a pair of sheet-like spreader members between the first and second advertising panels adjacent the top and bottom edges, respectively, each spreader member having a central region and integral first and second side regions, each side region being coupled to the central region by curved lines of reduced resistance to bending, the central region having a fold line therethrough;

when the advertising display is in a folded state, each spreader member being folded through 180° along the fold line, with the first and second side regions being bonded to the first and second advertising panels, respectively, with the fold line of the central region approximately perpendicular to the first and second opposite side edges of the panels; and, when the panels are encouraged into separation adjacent each of the spreader members, the spreader members will unfold along the fold line through the central region and fold along the curved lines of reduced resistance to bending such that the central region is unfolded and curved following a curvature of the curved lines, thereby holding the central region in an unfolded position;

one of the subassemblies having the side regions of one of the spreader members extending beyond the top or bottom edges of the advertising panels such that when the spreader members are in an open stable state, the side regions that extend beyond the top or bottom edges of the advertising panels will slip between the advertising panels of the other subassembly to form a larger advertising display.

9. The advertising display of claim 8 wherein each spreader member has a hole in the central region thereof which may be used as a finger hole to unfold said spreader member.

10. The advertising display of claim 8 wherein the central region of one of the spreader members has an integral tab at each end thereof, each tab having a hole therein such that the tabs are bent upward for hanging the display from above through the holes in the tabs.

11. The advertising display of claim 8 wherein the central region of one of the spreader members includes a pair of means for engaging a foot for providing a free standing display.

12. The advertising display of claim 11 further comprising a pair of feet, each of the feet comprising an assembly of a pair of substantially identical plastic feet members for elastically engaging a respective one of the means for engaging a foot for providing a free standing display.

13. The advertising display of claim 8 wherein the first and second advertising panels are individual sheet-like members, each folded along on one of the side edges and bonded to an unfolded side edge of the other sheet-like member.

14. The advertising display of claim 8 wherein the first and second advertising panels and the spreader members are corrugated cardboard members.

15. An advertising display method comprising the steps of:

providing an advertising panel having top and bottom edges and first and second opposite side edges;

providing a pair of sheet-like spreader members adjacent the top and bottom edges, respectively, each spreader member having a central region and integral first and second side regions, each side region being coupled to the central region by curved lines of reduced resistance to bending, the central region having a fold line therethrough;

in a folded state, folding each spreader member through 180° along the fold line, with the first and second side regions being bonded to the advertising panel, with the fold line of the central region approximately perpendicular to the first and second side edges of the panel; and, separating the panel adjacent each spreader member until each spreader member unfolds along the fold line through the central region and folds along the curved lines of reduced resistance to bending such that the central region is unfolded and curved following a curvature of the curved lines, thereby holding the central region in an unfolded position.

16. The advertising display method of claim 15 wherein the step of separating comprises separating the panel adjacent each spreader member until each spreader member unfolds along the fold line through the central region and folds 90° along the curved lines of reduced resistance to bending such that the central region is unfolded and curved following a curvature of the curved lines, thereby holding the central region in the unfolded position.

* * * * *